US009510117B2

(12) United States Patent
Barwicz et al.

(10) Patent No.: US 9,510,117 B2
(45) Date of Patent: Nov. 29, 2016

(54) DEVICE FOR MEASURING SOUND LEVEL

(71) Applicant: SVANTEK Sp. z o.o, Warsaw (PL)

(72) Inventors: Wieslaw Barwicz, Warsaw (PL); Ryszard Leoniak, Warsaw (PL); Lukasz Lukaszewski, Warsaw (PL); Grzegorz Kuzmiszyn, Warsaw (PL)

(73) Assignee: SVANTEK SP. ZO.O., Warsaw (PL)

( * ) Notice: Subject to any disclaimer, the term of this patent is extended or adjusted under 35 U.S.C. 154(b) by 177 days.

(21) Appl. No.: 14/519,206

(22) Filed: Oct. 21, 2014

(65) Prior Publication Data

US 2015/0139432 A1 May 21, 2015

(30) Foreign Application Priority Data

Oct. 30, 2013 (EP) ..... 13461555

(51) Int. Cl.

| | |
|---|---|
| ***H04R 19/04*** | (2006.01) |
| ***H04R 29/00*** | (2006.01) |
| ***H04R 1/20*** | (2006.01) |
| ***H04R 1/22*** | (2006.01) |
| ***H04R 19/00*** | (2006.01) |

(52) U.S. Cl.

CPC ..... *H04R 29/00* (2013.01); *H04R 1/20* (2013.01); *H04R 1/22* (2013.01); *H04R 1/222* (2013.01); *H04R 19/005* (2013.01); *H04R 19/04* (2013.01); *H04R 29/004* (2013.01); *H04R 2201/003* (2013.01)

(58) Field of Classification Search

CPC ..... H04R 1/08; H04R 1/083; H04R 1/22; H04R 1/222; H04R 1/225; H04R 1/38; H04R 17/00; H04R 19/005; H04R 19/04; H04R 2201/003; H04R 1/20; H04R 23/006; H04R 29/00; H04R 29/004

USPC ..... 381/337, 345, 346, 347, 349, 351, 353, 381/354, 355, 356, 357, 360, 174, 175; 181/160

See application file for complete search history.

(56) References Cited

U.S. PATENT DOCUMENTS

| | | | | |
|---|---|---|---|---|
| 3,246,721 A * | 4/1966 | Martin | H04R 1/225 181/160 |
| 4,949,387 A * | 8/1990 | Andert | H04R 17/00 310/324 |
| 2010/0049516 A1* | 2/2010 | Talwar | G10L 15/07 704/251 |
| 2013/0129133 A1* | 5/2013 | Inoda | H04R 1/08 381/337 |

FOREIGN PATENT DOCUMENTS

| | | |
|---|---|---|
| EP | 2373066 | 10/2011 |
| EP | 2592844 | 5/2013 |
| WO | 2013092706 | 6/2013 |

* cited by examiner

*Primary Examiner* — Huyen D Le
(74) *Attorney, Agent, or Firm* — Mark M. Friedman

(57) ABSTRACT

A device for measuring sound level, comprising: an inlet opening; a MEMS microphone for measuring sound level; and an external acoustic attenuator with a pressure divider comprising: a first branch between the inlet opening and the membrane of the MEMS microphone via an inlet channel and a resonant cavity; and a second branch between the resonant cavity and a vent chamber via a vent channel.

11 Claims, 5 Drawing Sheets

DEVICE FOR MEASURING SOUND LEVEL

TECHNICAL FIELD

This disclosure relates to a device for measuring sound level.

BACKGROUND

Many situations require measuring sounds having a high Sound Pressure Level (SPL), such as exceeding 130 or even 140 dB. The level of 140 dB can cause damage to human ears and therefore shall be monitored in working environments.

Sound dosimetry measurements can be performed using acoustic dosimeters. An exemplary dosimeter has been described in a US patent U.S. Pat. No. 7,913,565, which discloses a dosimeter comprising an electronic circuit for receiving at least one signal representing a hazardous level, equipped with a sensor, for example a microphone, and a processor for determining an accumulated dose in a specific measurement window.

The acoustic dosimeters which are now commercially available typically use capacitor microphones. The capacitor microphones provide good measurement parameters, but are relatively expensive. Moreover, they are sensitive to mechanical shocks and can be easily damaged, for example when dropped on a hard surface.

There are known MEMS microphones (MicroElectroMechanical Systems). MEMS microphones have a number of advantages, such as high resistance to mechanical impacts, small dimensions and low price. However, MEMS microphones have a relatively small dynamic range of measurement and are typically limited to measuring sound levels not exceeding 130 dB. Therefore, MEMS microphones cannot be directly used in acoustic dosimetry applications which require measuring sound levels higher than 140 dB SPL peak.

It is known that the upper measurement limit of the microphone can be raised by coupling the microphone with an external attenuator, to lower the acoustic pressure reaching the microphone membrane. The measurement limit of the microphone is therefore increased by the value of attenuation of the attenuator. However the method for making such attenuator for the wide frequency measurement range is not known. MEMS microphones have not been used so far in applications requiring sound level measurement higher than their capabilities, no external attenuator for MEMS microphone has been developed yet.

A European patent application EP2592844A1 discloses a microphone unit that includes a MEMS microphone within an enclosure that forms a first sound guide space and a second sound guide space separated by the diaphragm of the MEMS microphone from the first sound guide space. Therefore, the MEMS microphone is configured as a differential microphone. The unit is not particularly configured to attenuate sound level reaching the MEMS microphone to enable measurement of sound level higher than the capabilities of the MEMS microphone.

Therefore, there is a need to develop a device for measuring sound level using a MEMS microphone, with a sound measurement limit higher than the basic measurement limit of the MEMS microphone.

SUMMARY

There is presented a device for measuring sound level by a MEMS microphone, characterized in that the MEMS microphone is coupled with an external acoustic attenuator comprising a pressure divider configured to limit the acoustic pressure which reaches a membrane of the microphone via an inlet channel and a resonant cavity.

Further, there is presented a device for measuring sound level, comprising: an inlet opening; a MEMS microphone for measuring sound level; and an external acoustic attenuator with a pressure divider comprising: a first branch between the inlet opening and the membrane of the MEMS microphone via an inlet channel and a resonant cavity; and a second branch between the resonant cavity and a vent chamber via a vent channel.

Preferably, the pressure divider comprises a double-sectional channel, having a first inlet section which constitutes a portion of the inlet channel between the inlet opening of the acoustic attenuator and the resonant cavity, and a second vent section which constitutes a branch of the first inlet section and is connected with a vent chamber.

Preferably, the vent channel has acoustic impedance smaller than acoustic impedance of the inlet channel.

Preferably, the pressure divider comprises a dumping material layer mounted between the inlet opening of the acoustic attenuator and the resonant cavity, wherein the resonant cavity splits to the inlet channel and a vent channel coupled with a vent chamber.

Preferably, the resonant cavity is filled with a material absorbing acoustic energy.

Preferably, the device further comprises a TEDS memory storing information on the individual frequency characteristic of the device.

Preferably, the components of the device are positioned in a tight housing in the following order: an inlet opening of the inlet channel, a sealing set, the pressure divider, the resonant cavity, a PCB with the MEMS microphone, the vent chamber and a PCB with connector for coupling the device with external devices.

BRIEF DESCRIPTION OF FIGURES

The presented device is shown by means of exemplary embodiments on a drawing, in which.

DETAILED DESCRIPTION

Figure 1:
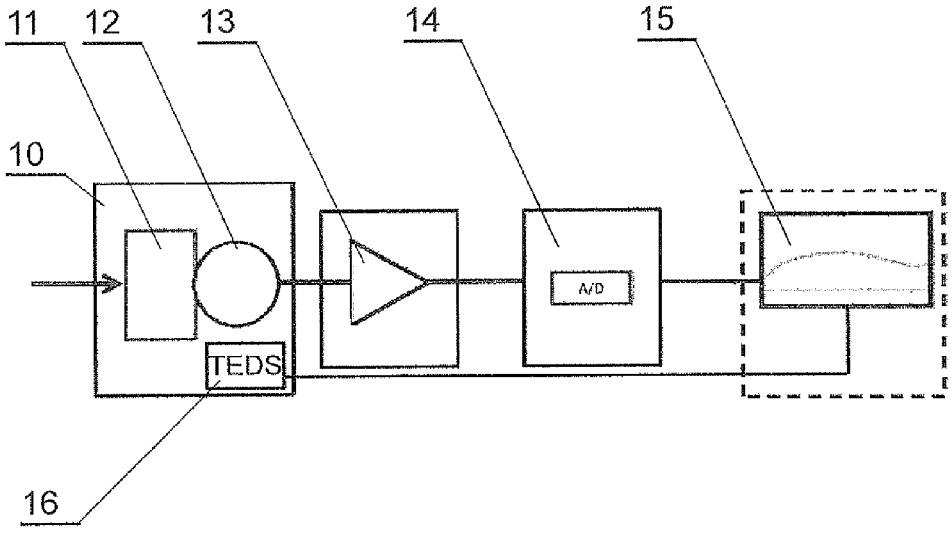
FIG. 1 shows a functional diagram of a system for measuring sound level.

A Functional Diagram of a System for Measuring Sound Level—FIG. 1

FIG. 1 shows a functional diagram of a system for measuring sound level. A device for measuring sound level 10 comprises an external acoustic attenuator 11 coupled with a MEMS microphone 12 and a TEDS memory 16. The acoustic attenuator 11 is called "external" as it is external with respect to the MEMS microphone 12, i.e. it does not form an integral part of the MEMS microphone 12. Signal measured by the MEMS microphone is input to an amplifier 13, and the amplified signal is input to an analog-digital converter 14. The acoustic attenuator 11 has a pressure divider having frequency-dependent acoustic impedance, therefore the resulting attenuation of the whole system is also frequency-dependent. The digital signal from the converter 14 is input to a digital correction filter 15 (such as a FIR filter), which smoothens the frequency characteristic so that it complies with the requirements of IEC61672:2003. The correction filter 15 can be coupled with the TEDS (Transducer Electronic Data Sheet) memory 16, which stores the frequency characteristic of the attenuator-microphone configuration (11-12). This allows dynamic adaptation of the characteristic of correcting filter 15.

The parameters and characteristics of the amplifier 13, the analog-digital converter 14 and the weighting filter 15 can be determined in a routine manner. Alternative equivalent circuits for processing the MEMS microphone 12 output signal, depending on the external acoustic attenuator 11 characteristic, can be determined routinely as well.

The elements 11, 12, 16 of the device 10 for measuring sound level are preferably mounted in a single, tight housing, which can be connected to another device, for example an acoustic dosimeter, in which the remaining elements 13, 14, 15 are mounted.

The device for measuring sound level comprises, in general, an inlet opening; a MEMS microphone for measuring sound level; and an external acoustic attenuator with a pressure divider. The pressure divider comprises a first branch between the inlet opening and the membrane of the MEMS microphone via an inlet channel and a resonant cavity; and a second branch between the resonant cavity and a vent chamber via a vent channel.

The pressure divider causes a drop of acoustic pressure that reaches the membrane of the microphone as compared to the level of acoustic pressure that reaches the housing of the whole arrangement. MEMS microphones have a very small membrane, which resonates with the small volume of air situated directly above it. The vent chamber influence the bottom frequency limit of the external acoustic attenuator. The larger the volume of the vent chamber, the lower the bottom frequency limit of the external acoustic attenuator arrangement. For very low frequencies, the input impedance decreases and the slow pressure changes are not dampened. The characteristic of the MEMS microphone is therefore compensated for low frequencies and the device can operate in a frequency range from 20 Hz, which complies with measurement standards.

Figure 2:
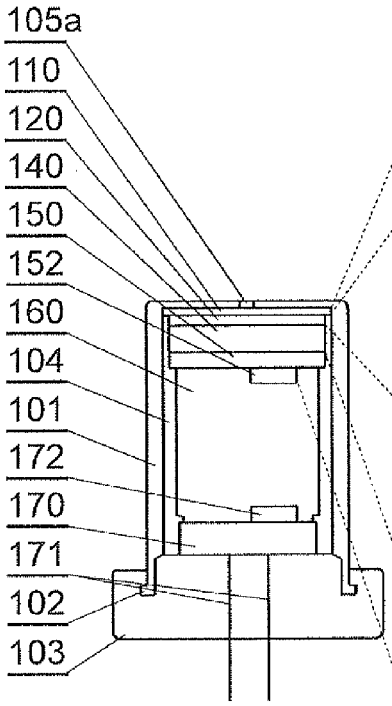
FIGS. 2 and 3 show schematically the mechanical construction of the first embodiment of the acoustic attenuator and the MEMS microphone.
Figure 3:
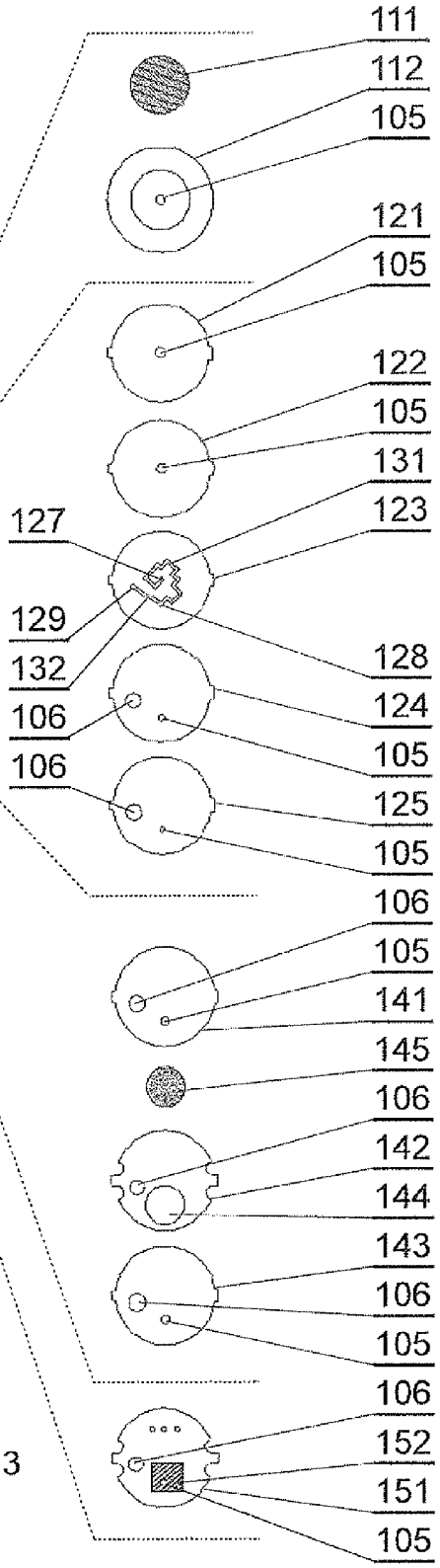

Mechanical Construction—First Embodiment—FIGS. 2 and 3

FIGS. 2 and 3 show the mechanical construction of the first embodiment of the acoustic attenuator coupled with the MEMS microphone, wherein FIG. 2 shows the schematic construction in a vertical cross-section, and FIG. 3 shows schematically individual components in a top view.

The components of the device are mounted in a housing 101, which provides their tight connection. The housing 101 has a collar 102 cooperating with a nut 103 for tight connection with the measurement device. A bushing 104 and a press ring provide mutual sealing of the elements mounted in the housing.

An inlet opening 105*a* in the top part of the housing 101 leads to an inlet channel 105.

A sealing set 110 is mounted under the inlet opening 105*a*. It comprises a net 111 for protecting the inlet channel 105 from dirt and a seal 112 with an opening forming the inlet channel 105.

Below the sealing set 110 there is mounted a pressure divider 120, which comprises the following elements arranged consecutively: a top plate 121, a top fastener 122 (e.g. a self-adhesive pad), a channel plate 123, a bottom fastener 124 and a bottom plate 125. The elements 121, 122, 124, 125 are used to seal the whole arrangement and force the propagation of acoustic waves through the channel plate 123. They also contribute to the long-term stability of the channel plate. The plate 123 has a cut-through which forms a channel, which begins in a start point 127 connected with the inlet channel 105, passes through a mid-point 128 and ends in an end point 129 connected with a vent channel 106. Therefore, the channel has two sections: an inlet section 131 between the start point 127 and the mid-point 128 and a vent section 132 between the mid-point 128 and the end point 129. The shape of the channel in inlet section 131 and the vent section 132 is selected experimentally, depending on the desired attenuation characteristic.

Below the pressure divider 120 there is a resonant chamber 140, which comprises the following elements arranged consecutively: a top seal 141, a spacer plate 142 and a bottom seal 143. The seals 141, 143 have openings forming the vent channel 106 and openings forming the inlet channel 105. The spacer plate 142 has an opening forming the vent channel 106 and an opening forming a resonant cavity 144. The resonant cavity 144 is filled with a material 145 for absorbing acoustic energy, for example mineral wool. The resonant cavity 144 has a volume selected according to the desired attenuation characteristic.

Below the resonant chamber 140 there is mounted a microphone unit 150, which comprises a printed circuit board (PCB) 151 with an opening forming the end of the inlet channel 105. A MEMS microphone 152 is soldered to the bottom side of the PCT 151. The MEMS microphone 152 has its membrane pointed upwards, such that it faces the inlet channel 105. The PCB 151 further comprises the vent channel opening 106 and conducting paths for powering the MEMS microphone and for transmitting the measured signal.

Below the microphone unit 150 there is a vent chamber 160, formed by an empty space limited by the PCB 151, the walls of the bushing 104 and a PCB 170.

The PCB 170 comprises power and signal connectors. Connector pins 171 are used to connect the device for measuring sound level with a measurement device, in particular with an acoustic dosimeter. The PCB 170 is connected with the PCB 151 (connection not shown to simplify the drawing) such as to provide signal and power connections to the MEMS microphone 152. The PCB 170 has the TEDS memory 172 mounted thereon. The TEDS memory 172 stores the individual characteristic of the device, which allows for dynamic adaptation of the compensation filter. In case the device for measuring sound level is damaged, it can be replaced in the dosimeter by another device of the same type but having a different characteristic. The compensation filter of the acoustic dosimeter will then adapt to the characteristic defined by the TEDS memory of the replaced device.

Therefore, the pressure divider comprises a first branch between the inlet opening 105*a* and the membrane of the MEMS microphone 152, which guides sound via an inlet channel 105 and a resonant cavity 144; and a second branch between the resonant cavity 144 and a vent chamber 160 which guides sound via a vent channel 106.

Exemplary Parameters of the Presented First Embodiment

In exemplary first embodiment presented, the housing has a form of a cylinder made of stainless steel, having a diameter of 0.5 inch, which is typically used for acoustic measurement devices. The part of the inlet channel formed by the openings in elements 112, 121, 122 has a constant diameter equal to 1 mm. The plate 123 has a thickness of 0.3 mm, and the width of its channel is 0.3 mm, so that the inlet section 131 and the vent section 132 have a cross-section with dimensions of 0.3 mm×0.3 mm. The vent channel 106, formed by the openings in elements 124, 125, 141, 142, 143, 151 has a constant diameter equal to 2 mm. The spacer plate 142 is 1.2 mm thick and the opening of the resonant cavity has a diameter equal to 4 mm. The further part of the inlet channel 105, between the plate 123 and the resonant cavity 144, formed by the openings in elements 124, 125, 141, has a constant diameter equal to 0.5 mm. The further part of the inlet channel 105, between the resonant cavity 144 and the MEMS microphone 152, formed by the openings in elements 143, 151 has a constant diameter equal to 0.5 mm. The vent chamber has a volume of about 1000 $mm^3$. The MEMS microphone is ADMP411 by Analog Devices.

Device Operation

The pressure divider 120 cooperates directly with the vent chamber 160 and causes a drop of acoustic pressure that reaches the membrane of the microphone 152 as compared to the level of acoustic pressure that reaches the housing of the whole arrangement. The pressure drop is proportional to the ratio of the acoustic impedance of the vent channel 106 and the acoustic impedance of the inlet channel 105.

MEMS microphones have a very small membrane, which resonates with the small volume of air situated directly above it. In order to achieve a stable frequency of that resonance and to limit its amplitude (i.e. goodness of the resonant system), the additional resonance cavity 144 has been introduced. The resonant cavity 144 is filled with a material 145 absorbing the acoustic energy. The cavity 144 is positioned directly in front of the MEMS microphone.

The vent chamber 160 forms the acoustic pressure divider and it determines the bottom frequency limit of the external acoustic attenuator. The larger the volume of the vent chamber 160, the lower the bottom frequency limit of the external acoustic attenuator arrangement.

It is essential to provide full tightness of the whole arrangement, such as not to allow the acoustic pressure to penetrate the components in an uncontrollable manner, i.e. another way than defined by the arrangement. For example, the acoustic pressure cannot reach the vent chamber such that it omits (bypasses) the pressure divider. Therefore, the arrangement comprises a number of seals 112, 122, 124, 141, 143 which are made of, for example, silicone rubber. The press bushing 104 with a pressing ring presses the divider arrangement 120 towards the upper part of the housing 101.

Exemplary Characteristic

Figure 4:
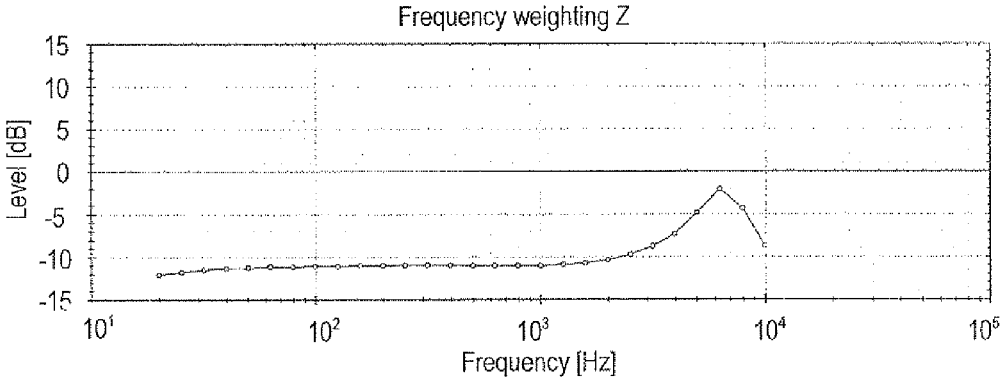
FIG. 4 shows an exemplary pressure characteristic of the system of the first embodiment without a resonant cavity.
Figure 5:
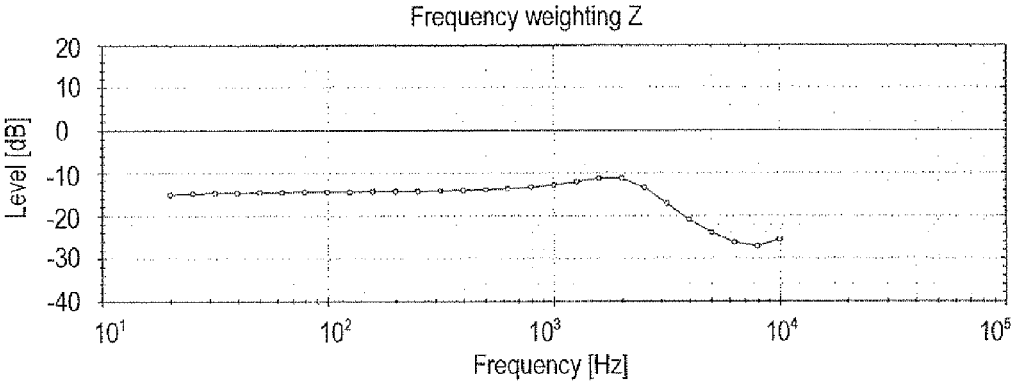
FIG. 5 shows an exemplary pressure characteristic of the system of the first embodiment with a resonant cavity.

FIG. 4 shows schematically an exemplary pressure characteristic of the arrangement without the resonant cavity (an undesired resonance effect of the MEMS microphone is observable), and FIG. 5 shows an exemplary characteristic of the arrangement with the resonant cavity present (thus neutralizing the undesired resonance effect of the MEMS microphone) before applying a compensation filter.

The presented external (with respect to the MEMS microphone) acoustic attenuator provides attenuation of more than 10 dB, which allows to extend the measurement range of a standard MEMS microphone from e.g. 130 dB to 140 dB, so that the device for measuring sound level as described herein can be used in acoustic dosimeters for measuring sound in workplaces, where it is necessary to measure sound levels of 140 dB.

Figures 6, 7:
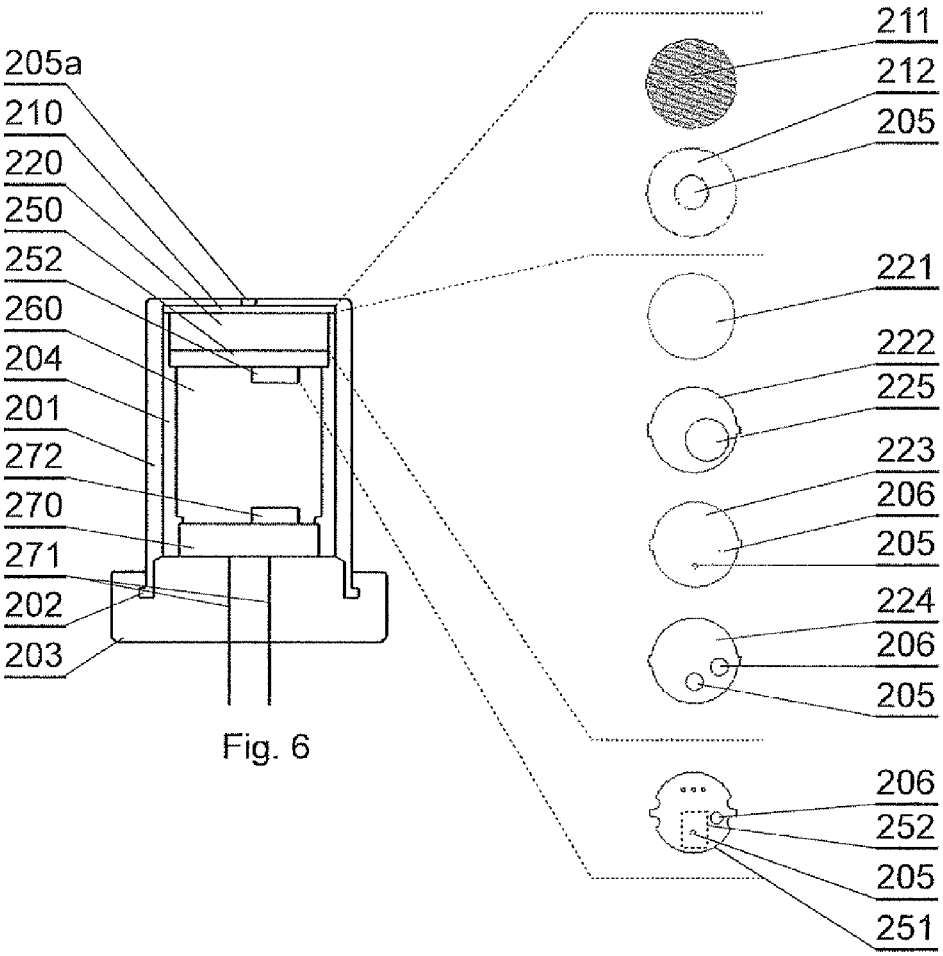
FIGS. 6 and 7 show schematically the mechanical construction of the second embodiment of the acoustic attenuator and the MEMS microphone.

Mechanical Construction—Second Embodiment—FIGS. 6 and 7

FIGS. 6 and 7 show the mechanical construction of the second embodiment of the external acoustic attenuator coupled with the MEMS microphone, wherein FIG. 6 shows the schematic construction in a vertical cross-section, and FIG. 7 shows schematically individual components in a top view.

The components of the device are mounted in a housing 201, which provides their tight connection. The housing 201 has a collar 202 cooperating with a nut 203 for tight connection with the measurement device. A bushing 204 and a press ring provide mutual sealing of the elements mounted in the housing.

An inlet opening 105*a* in the top part of the housing 201 leads to an inlet channel 205.

A sealing set 210 is mounted under the inlet opening 105*a*. It comprises a net 211 for protecting the inlet channel 205 from dirt and a seal 212 with an opening forming the inlet channel 205.

Below the sealing set 210 there is mounted a pressure divider 220. The first element of the pressure divider is a dumping material layer 221, made for example of polyethylene frit having a thickness of 1 mm, which forms the inlet acoustic impedance (channel) together with the opening 225 of the pressure divider. The dumping material layer 221 is followed by a first seal 222, a plate 223 and a second seal 224. The first seal 222 comprises a large opening 225 which is connected with the dumping material layer 221. The second seal 224 comprises the inlet channel 205 opening and the vent channel 206 opening.

The opening 225 also functions as a resonant cavity, forming the resonant chamber together with the dumping material layer 221. The volume of the resonant cavity 225 is selected according to the desired attenuation characteristic, it can be adjusted by varying the thickness of the seal 222 or the diameter of the opening 225. In general, the resonant frequency is inversely proportional to the square of the volume of the resonant cavity.

Below the pressure divider chamber 220 there is mounted a microphone unit 250, which comprises a printed circuit board (PCB) 251 with an opening forming the end of the inlet channel 205. A MEMS microphone 252 is soldered to the bottom side of the PCT 251. The MEMS microphone 252 has its membrane pointed upwards, such that it faces the inlet channel 205. The PCB 251 further comprises vent channel opening 206 and conducting paths for powering the MEMS microphone and for transmitting the measured signal.

Below the microphone unit 250 there is a vent chamber 260, formed by an empty space limited by the PCB 251, the walls of the bushing 204 and a PCB 270.

The PCB 270 comprises power and signal connectors. Connector pins 271 are used to connect the device for measuring sound level with a measurement device, in particular with an acoustic dosimeter. The PCB 270 is connected with the PCB 251 (connection not shown to simplify the drawing) such as to provide signal and power connections to the MEMS microphone 252. The PCB 270 has the TEDS memory 272 mounted thereon. The TEDS memory 272 stores the individual characteristic of the device, which allows for dynamic adaptation of the compensation filter. In case the device for measuring sound level is damaged, it can be replaced in the dosimeter by another device of the same type but having a different characteristic. The compensation filter of the acoustic dosimeter will then adapt to the characteristic defined by the TEDS memory of the replaced device.

Therefore, the pressure divider comprises a first branch between the inlet opening 205*a* and the membrane of the MEMS microphone 252, which guides sound via an inlet channel 205 and a resonant cavity 225; and a second branch between the resonant cavity 225 and a vent chamber 260 which guides sound via a vent channel 206.

Exemplary Parameters of the Presented Second Embodiment

In exemplary second embodiment presented, the housing has a form of a cylinder made of stainless steel, having a diameter of 0.5 inch, which is typically used for acoustic measurement devices. The inlet channel 205 opening in element 212 has a diameter equal to 4 mm. The dumping material layer 221 has a thickness of 1 mm. The opening 225 in the pressure divider top seal 222 has a diameter of 5 mm and the thickness of the seal 222 is 0.7 mm. The diameter of the lower section of the inlet channel 205 formed by openings in elements 223, 224 is about 0.5 mm. The diameter of the vent channel 206 formed by opening in plate 223 is 0.15 mm and the thickness of the plate 223 is 0.1 mm. The diameter of the vent channel 206 formed by opening in seal 224 is 0.5 mm. The openings on the drawing are not drawn in scale, in order to keep drawing clarity. The vent chamber has a volume of about 1000 $mm^3$. The MEMS microphone is ADMP411 by Analog Devices.

Device Operation

The pressure divider 220 cooperates directly with the vent chamber 260 and causes a drop of acoustic pressure that reaches the membrane of the microphone 252 as compared to the level of acoustic pressure that reaches the housing of the whole arrangement. The pressure drop is proportional to the ratio of the acoustic impedance of the vent channel 206 and the acoustic impedance of the inlet channel 205. The acoustic impedance of the inlet channel depends mainly on the impedance of the dumping layer 221 and the acoustic impedance of the vent channel 206 depends mainly on the diameter of the vent channel 206.

The vent chamber 260 forms the last part of the acoustic pressure divider and it determines the bottom frequency limit of the external acoustic attenuator. The larger the volume of the vent chamber 260, the lower the bottom frequency limit of the external acoustic attenuator arrangement.

Figure 8:
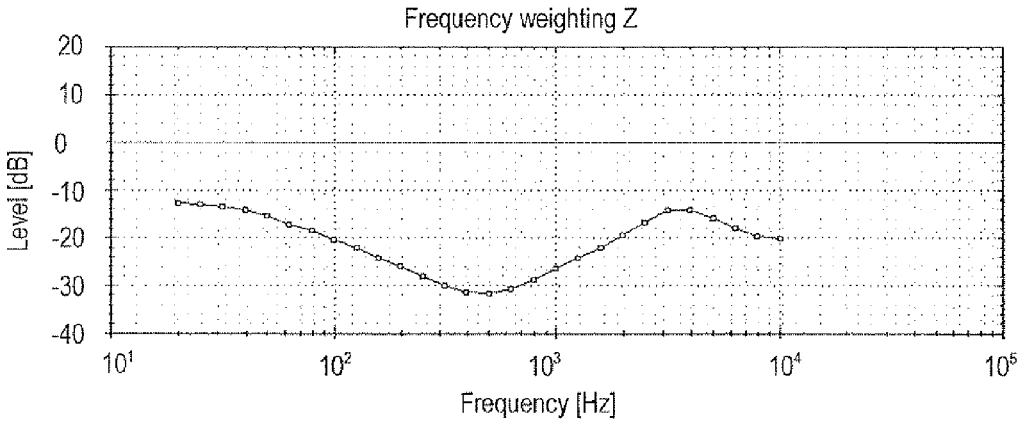
FIGS. 8 and 9 show exemplary pressure characteristics of the system of the second embodiment for different diameters of the vent opening.
Figure 9:
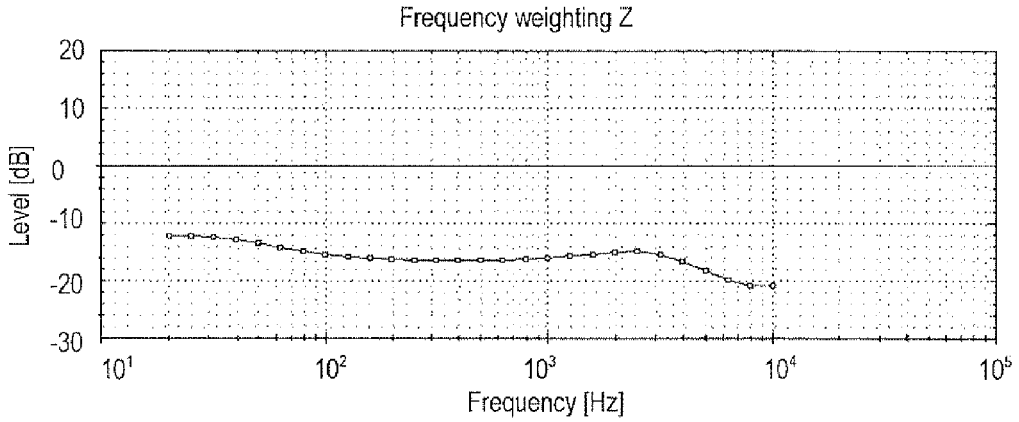

FIGS. 8 and 9 show exemplary pressure characteristics of the system of the second embodiment for different diameters of the vent opening: 0.3 mm and 0.15 mm.

It is essential to provide full tightness of the whole arrangement, such as not to allow the acoustic pressure to penetrate the components in an uncontrollable manner, i.e. another way than defined by the arrangement. For example, the acoustic pressure cannot reach the vent chamber such that it omits (bypasses) the pressure divider. Therefore, the arrangement comprises a number of seals 212, 222, 224, which are made of, for example, silicone rubber. The press bushing 204 with a pressing ring presses the divider arrangement 220 towards the upper part of the housing 201.

The second embodiment has a simpler construction than the first embodiment, therefore it is easier to manufacture and assembly such as to provide accurate tightness. Moreover, the acoustic impedance parameters of the inlet channel 205 are more accurately controllable by appropriate selection of the dumping material layer 221 and the diameter of the vent channel 206, as compared to the cut-through of the plate 223.

The invention claimed is:

1. A device for measuring sound level, comprising:
an inlet opening;
a MEMS microphone for measuring sound level; and
an external acoustic attenuator with a pressure divider comprising:
a first branch between the inlet opening and the membrane of the MEMS microphone via an inlet channel and a resonant cavity; and
a second branch between the resonant cavity and a vent chamber via a vent channel,
wherein the pressure divider comprises a dumping material layer mounted between the inlet opening of the external acoustic attenuator and the resonant cavity, wherein the resonant cavity splits to the inlet channel and a vent channel coupled with a vent chamber.

2. The device according to claim 1, wherein the vent channel has acoustic impedance smaller than acoustic impedance of the inlet channel.

3. The device according to claim 1, wherein the resonant cavity is filled with a material absorbing acoustic energy.

4. The device according to claim 1, further comprising a TEDS memory storing information on an individual frequency characteristic of the device.

5. The device according to claim 1, wherein the components of the device are positioned in a tight housing in the following order: an inlet opening of the inlet channel, a sealing set, the pressure divider, the resonant cavity, a PCB with the MEMS microphone, the vent chamber and a PCB with connector for coupling the device with external devices.

6. A device for measuring sound level, comprising:
an inlet opening;
a MEMS microphone for measuring sound level; and
an external acoustic attenuator with a pressure divider comprising:
a first branch between the inlet opening and the membrane of the MEMS microphone via an inlet channel and a resonant cavity; and
a second branch between the resonant cavity and a vent chamber via a vent channel,
wherein the components of the device are positioned in a tight housing in the following order: an inlet opening of the inlet channel, a sealing set, the pressure divider, the resonant cavity, a PCB with the MEMS microphone, the vent chamber and a PCB with connector for coupling the device with external devices.

7. The device according to claim 6, wherein the pressure divider comprises a double-sectional channel, having a first inlet section which constitutes a portion of the inlet channel between the inlet opening of the external acoustic attenuator and the resonant cavity, and a second vent section which constitutes a branch of the first inlet section and is connected with the vent chamber.

8. The device according to claim 7, wherein the vent channel has acoustic impedance smaller than acoustic impedance of the inlet channel.

9. The device according to claim 6, wherein the pressure divider comprises a dumping material layer mounted between the inlet opening of the external acoustic attenuator and the resonant cavity, wherein the resonant cavity splits to the inlet channel and a vent channel coupled with a vent chamber.

10. The device according to claim 6, wherein the resonant cavity is filled with a material absorbing acoustic energy.

11. The device according to claim 6, further comprising a TEDS memory storing information on an individual frequency characteristic of the device.

* * * * *